US006029362A

United States Patent [19]

Miodragovic

[11] Patent Number: 6,029,362

[45] Date of Patent: Feb. 29, 2000

[54] ALIGNMENT DEVICE

[76] Inventor: Milan Miodragovic, Sandstrasse 14, CH-5416 Kirchdorf, Switzerland

[21] Appl. No.: 08/869,824

[22] Filed: Jun. 5, 1997

[30] Foreign Application Priority Data

Jun. 10, 1996 [CH] Switzerland ..... 1444/96
Feb. 14, 1997 [CH] Switzerland ..... 0338/97

[51] Int. Cl.[7] ..... B25H 7/04; B43L 7/00

[52] U.S. Cl. ..... 33/666; 33/485; 33/483; 33/613

[58] Field of Search ..... 33/613, 666, 669, 33/562, 483, 485, 484

[56] References Cited

U.S. PATENT DOCUMENTS

| | | | |
|---|---|---|---|
| 776,897 | 12/1904 | Ferris | 33/485 |
| 2,594,193 | 4/1952 | Mendes | 33/485 |
| 4,241,510 | 12/1980 | Radecki | 33/189 |
| 4,443,949 | 4/1984 | Newton | 33/191 |
| 4,648,185 | 3/1987 | Brandimarte | 33/189 |
| 5,103,573 | 4/1992 | Ehling et al. | 33/613 |
| 5,402,585 | 4/1995 | Lund | 33/484 |
| 5,451,027 | 9/1995 | McHenry | 33/613 |
| 5,509,213 | 4/1996 | Kelly et al. | 33/613 |

FOREIGN PATENT DOCUMENTS

| | | | |
|---|---|---|---|
| 147301 | 6/1990 | Japan | 33/483 |

*Primary Examiner*—Christopher W. Fulton
*Assistant Examiner*—Quyen Doan
*Attorney, Agent, or Firm*—Edwin D. Schindler

[57] ABSTRACT

An article for aligning and establishing fastening points for attachment means, such as nails, pegs and hooks, for the arrangement and hanging of pictures and picture frames, as well as for marking fastening points at either selected horizontal or vertical distances from one another for wall plates and built-in units in building construction, is disclosed. The alignment article includes at least one bubble level mounted in a frame, with a cursor having a first borehole guided along the frame. The first borehole is guided along the frame, with such first borehole lying over a slit designed in the frame and running parallel to the longitudinal edges thereto, and with at least one, further, or second, borehole situated at one of the ends of the frame. The cursor is constructed for grabbing the frame in a C-shape. A plurality of steps is further provided for an exact guiding on the outerlying longitudinal edges of the frame, which cooperate with correspondingly designed surfaces on an internal contour of the cursor.

10 Claims, 3 Drawing Sheets

ALIGNMENT DEVICE

BACKGROUND OF INVENTION

1. Technical Field of the Invention

The present invention, generally, relates to an article for aligning and fixing, or marking, particular fastening points, which are situated at mutually, selected vertical or horizontal distances from one another, for securing wall plates, pictures, built-in wall units and the like, in home or other building construction.

Once the fastening points are selected in either vertical and/or horizontal relationship to one another, nails, pegs or hooks, etc., can properly and accurately be driven into the wall of the building of concern.

2. Description of the Prior Art

Arranging and hanging-up pictures cannot readily be accomplished by a single, central nail or hook, but, instead, requires two spaced apart pegs, nails or the like. An accurate placement of such spaced apart pegs is often quite difficult and not successful. The accurate and proper fixing or alignment of two or more nails, or other means for attachment, cannot readily be accomplished by simply measuring relevant distances between the floor and ceiling in a room intended for containing the wall fixture in question, because the attachment means are, frequently, not aligned properly in either the horizontal or vertical directions. An additional difficulty is that measurement of the distances in question must be measured simultaneously with the fixing of a common horizontal line.

A mason's level, such as that used by construction workers, for example, is of only limited assistance, since it is often very difficult to hold the level horizontally, without the aid of another person, while hammering or screwing the attachment means into place. Further, the application of pencilled lines, or the like, on clean walls is neither desirable nor aesthetically acceptable.

Even the marking of fastening points for wall plates or built-in units in house construction, such as, for example, furniture, kitchen units, etc., is often complicated when a normal level is used—and pencilled lines often have to be used for the exact designation of lateral distances. These markings, frequently, cannot be removed at a later time. Customarily, instead of pencilled markings, such lines are frequently made with colored markers, which will eventually shine through and remain visible, even after being painted over.

SUMMARY OF THE INVENTION

It is, therefore, an object of the present invention to provide an article for rendering possible, in a simple and precise manner, an exact horizontal hanging of, for example, pictures, frames and the like, without the need for pencilled lines or the difficulties attendant to prior art devices.

It is a further object of the present invention to provide an article for rendering possible, in a simple and precise manner, an exact horizontal or vertical marking of fastening points for wall plates and built-in units, etc., common in building construction.

The foregoing and related objects are accomplished by the present invention for an article for aligning and establishing fastening points for attachment means, such as nails, pegs and hooks, for the arrangement and hanging of pictures and picture frames, as well as for marking fastening points at either selected horizontal or vertical distances from one another for wall plates and built-in units in building construction. The article of the present invention includes at least one bubble level mounted in a frame, with a cursor having a first borehole guided along the frame. The first borehole is guided along the frame, with such first borehole lying over a slit designed in the frame and running parallel to the longitudinal edges thereto, and with at least one, further, or second, borehole situated at one of the ends of the frame. The cursor is constructed for grabbing the frame in a C-shape. A plurality of steps is provided for an exact guiding on said outerlying longitudinal edges, which cooperate with correspondingly designed surfaces on an internal contour of the cursor.

The device of the present invention enables a single individual to set two spaced apart nails, pegs or markings at exactly the same height, i.e., horizontally, and additionally at the exact mutually correct distance on a wall, without the aid of a distance measuring device. The article of the presently claimed invention further enables the setting of nails lying very close to one another or, in the case of large pictures, far apart from each other, at the exact same height, i.e., horizontal, at the precisely prescribed distance. The article of the present invention is extremely economical to manufacture and can therefore be acquired by anyone who only occasionally has cause to hang a picture or similar article. In addition, the alignment article of the present invention can be used without any special technical training.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
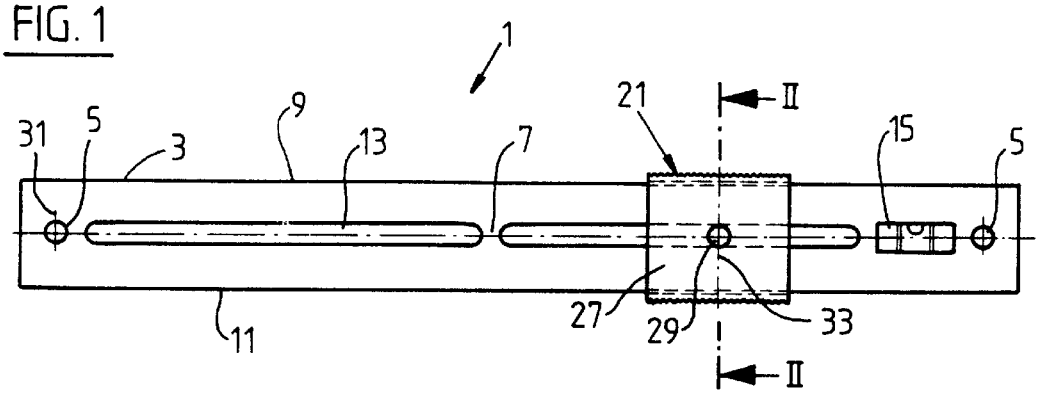
FIG. 1 is an elevational view of the front side of the alignment article of the present invention.
Figure 2:
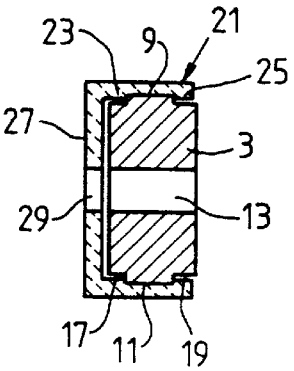
FIG. 2 is a cross-sectional view, taken along the II—II line of the alignment article of FIG. 1.
Figure 3:
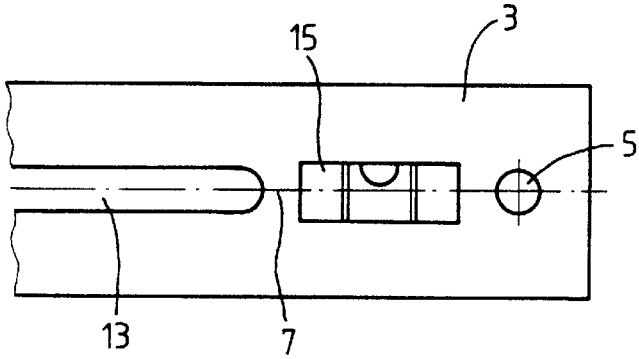
FIG. 3 is an enlarged cross-sectional view of an end of the alignment article, which includes a mason's level.

Turning now, in detail, to an analysis of the drawing figures, the alignment article 1 is illustrated and includes a bar-shaped frame 3, which is essentially rectangular in cross-section, having at least one, but preferably two, boreholes 5, at the end of frame 3. The borehole 5 lies along line 7, which is present as a fine scratch or streak and which runs parallel to the two longitudinal edges 9, 11 of frame 3. A slit-shaped recess 13, which breaks through the frame 3, likewise, lies symmetrical to the line 7. This slit-shaped recess 13, which penetrates through frame 3, can essentially extend across the entire length of frame 3, or be interrupted in the central region thereof in order to counteract a diminishment of the flexural strength of article 1. A bubble level 15, with which the device can be aligned relative to the horizontal, is mounted at one end. The frame 3 is, preferably, manufactured of transparent plastic, which is resistant to bending.

The four longitudinal edges of frame 3 can have steps 17, 19, serving as longitudinal guides for a slide or cursor 21, on the four corners. The cursor 21 has a U-shaped cross-section. Cursor 21 can be manufactured of transparent plastic and can be supplied with ledges 23, 25 engaging steps 17, 19. These ledges 23, 25 are measured so that the front panel 27, which comes to be situated over the frame's 3 surface, lies at a small distance from the surface of the frame 3, thereby precluding damage or dirtying of the surface when moving cursor 21. A second borehole 29, which aligns with the slit 13 in the frame 3, is imbedded into the front panel 27. Both the first borehole 5, of which there is at least one such borehole, and the borehole 29 in the cursor 21, lie on a vertical guideline 31, 33 flush-mounted into the frame 3 or into the front panel 27, respectively.

Figure 4:
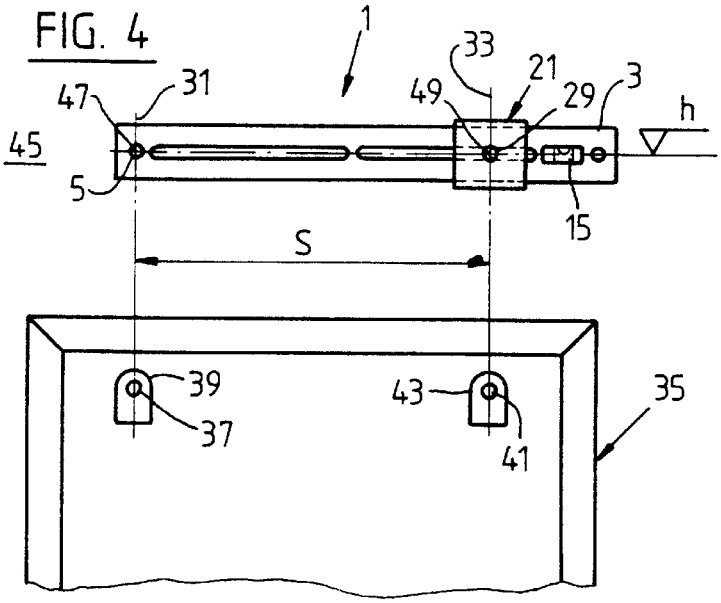
FIG. 4 is a plan view intended to illustrate use of the alignment article of the present invention.
Figure 5:
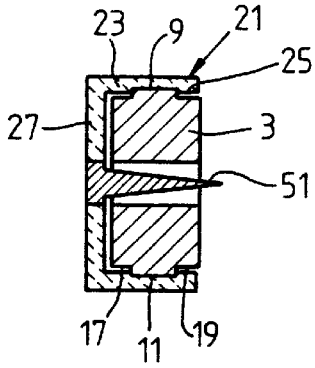
FIG. 5 is a cross-sectional view taken through the alignment article, with a centering pin.

The functional operation of the alignment article 1 of the present invention, will be explained in greater detail, with particular attention being paid to FIG. 4:

The frame 3 is placed on the back side of a picture or picture frame 35, which is to be hung. The first borehole 5 in the frame 3 is pushed over the hole 37 on the first bracket 39. The second borehole 29, in the cursor 21, is centered over the eye 41 in the second bracket 43.

A nail 47 is hammered into the wall 45 at the desired height or a marking is made at the appropriate point.

The alignment device is pivoted on the nail 47, which is inserted into the borehole 5, and is turned around the center of the nail 47 or around a marking arbor until the mason's level 15 attains or indicates a horizontal position. Thereafter, the impact point can be directly marked with a pencil, a second nail 49, or a marking arbor.

Now, the alignment article 1 is set aside and the second nail 49 (and also the first, in the case wherein only a mark was made), is hammered into the wall. This second nail 49 is now lying at exactly the same height h at the first nail 47. Consequently, the picture will hang on the wall in a perfect horizontal alignment.

It is further possible to locate or insert a centering arbor 51 into the first borehole 29 and into a second borehole at 5. This centering arbor 51 can be used for the corresponding markings on the wall 45 for hammering the nails 47, 49 in place of a pencil, which is guided through the boreholes 5, 29, respectively.

Figure 7:
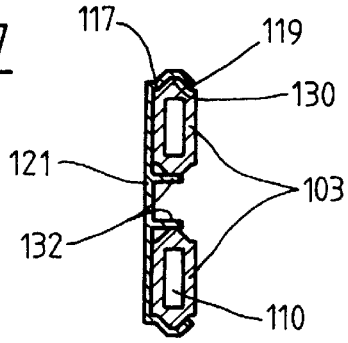
FIG. 7 is a cut-out view taken along the VII—VII line of the alignment article of FIG. 6.
Figure 8:
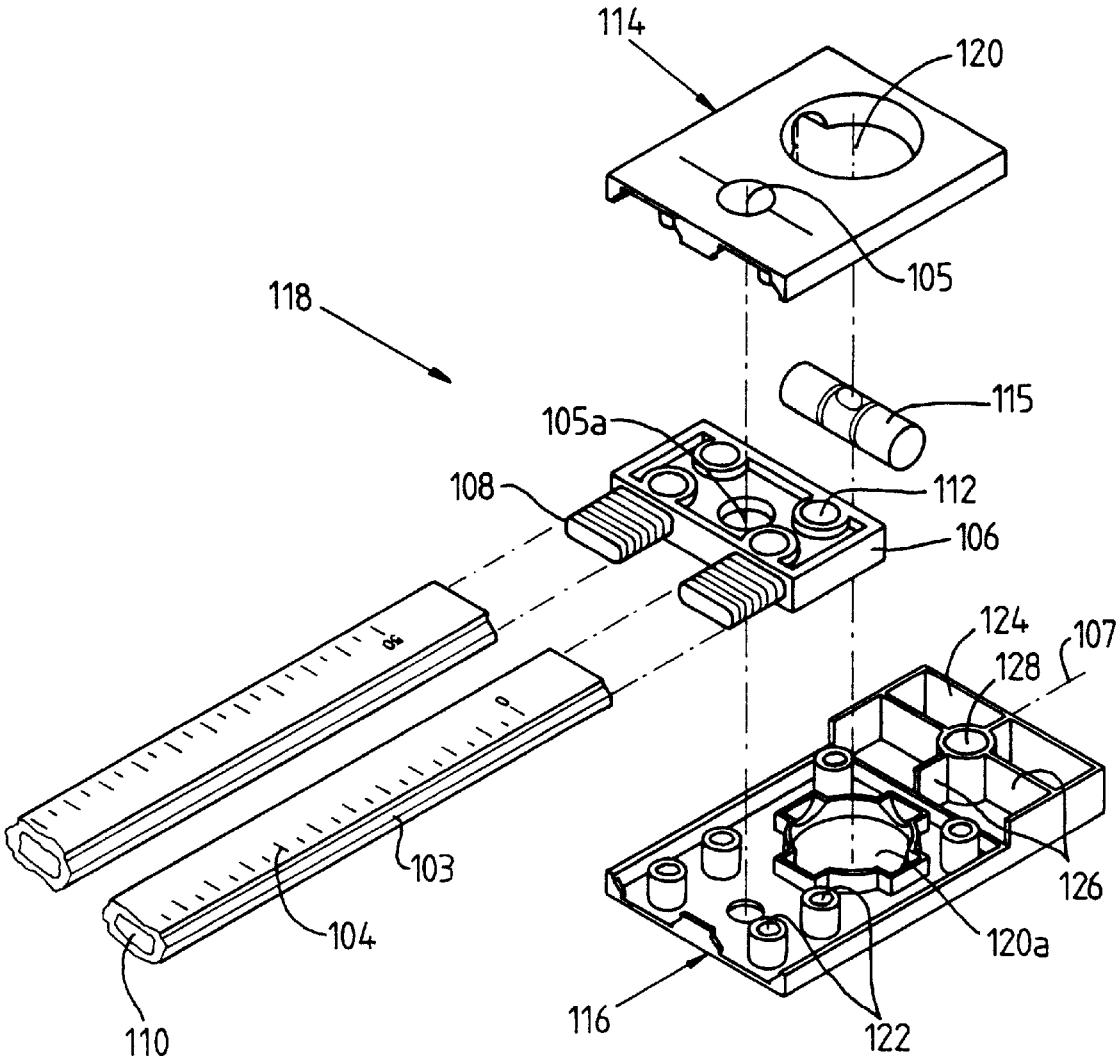
FIG. 8 is an enlarged, exploded perspective view of the alignment article and an end piece having a mason's level; and, FIG. 9 is a full perspective view of a further preferred embodiment of the alignment article of the present invention, which includes a swivelling feature.

In a second preferred embodiment of the present invention, alignment device 101 contains two bar-shaped frames 103, the cross-section of which is shown in FIG. 7. The bar-shaped frames 103 can carry scales 104, which were engraved or applied by screen process printing or an analogous procedure. Preferably, the bar-shaped frames 103, spaced by a slit 113, will include a hollow section of drawn aluminum, the surface of which may later be anodized. Retaining elements 106 (as shown in FIG. 8) are fastened on both sides of the two bar-shaped frames 103. These retaining elements 106 contain two pegs 108, the surfaces of which are roughened or supplied with ledges and which lie snugly and tightly held in the hollow section 110 of the bar-shaped frames 103 after they have been inserted into it. The retaining frames 106, which hold the ends of the bar-shaped frames 103 on both sides and align them precisely, have a conical borehole 105 in the center. Four additional boreholes 112 serve to fasten a cover plate 118 having parts 114, 116. Part 114 is essentially rectangular and has a small borehole 105, which comes to lie over the borehole 105*a*, as well as a larger recess 120, in which a bubble level can be mounted. Small pegs, which are not visible, are provided to engage the corresponding boreholes 112 on part 116, and are located on the underside of part 114. Part 116 is, likewise, essentially rectangular and has a recess 120*a* opposite recess 120. Additionally, a frame 124 is designed laterally on part 116. A borehole 128, connected by fins 126, serving as a supporting network, is designed in the center of the frame 124. The borehole 105, the recess 120*a*, and the borehole 129 all lie on a line 107, lying parallel to the edges of the bar-shaped frames 103. The parts 114, 116 can be stiffly connected to the retaining frame 106 by pressing them together. Preferably, two bubble levels 115 mounted into the cover plates 118 lie at an angle of 90°. This enables the user of the alignment device to also fix markings which come to lie exactly vertically one above another.

The two bar-shaped frames 103 have trapezoidal bulges 130, which are arranged between the two steps 117, 119, on both sides thereof. Two elastic flaps 132 are designed in the center of the cursor 121 for maintaining the appropriate friction between the cursor 121 and the two-bar shaped frames 103.

Figure 6:
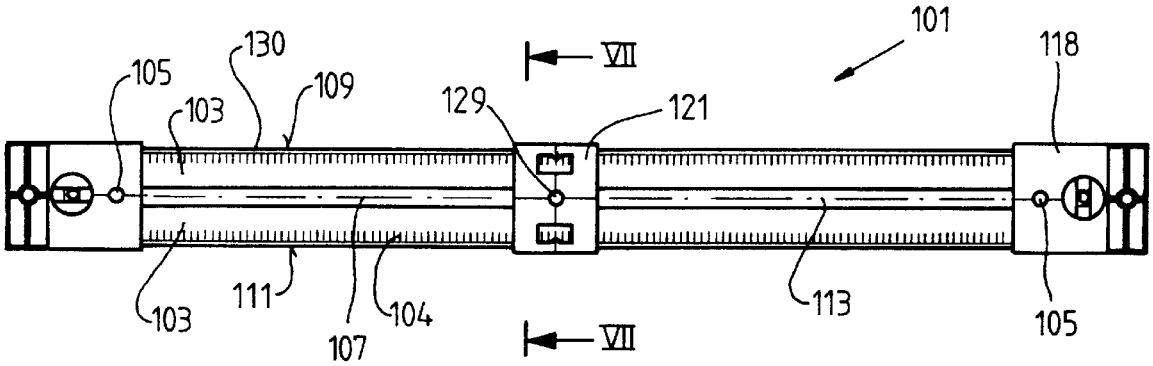
FIG. 6 is an elevational view of an additional preferred embodiment of the alignment article of the present invention.

The functional operation of the preferred embodiment of the invention as in FIGS. 6–8 is substantially the same as that for the earlier-disclosed preferred embodiments.

It should be understood that the alignment device of present invention can not only be applied for hanging up pictures, but can also be used just as advantageously for marking fastening points for built-in furniture and even for aligning and setting markings for the placement of ceramic and natural stone tiles along walls.

Figure 9:
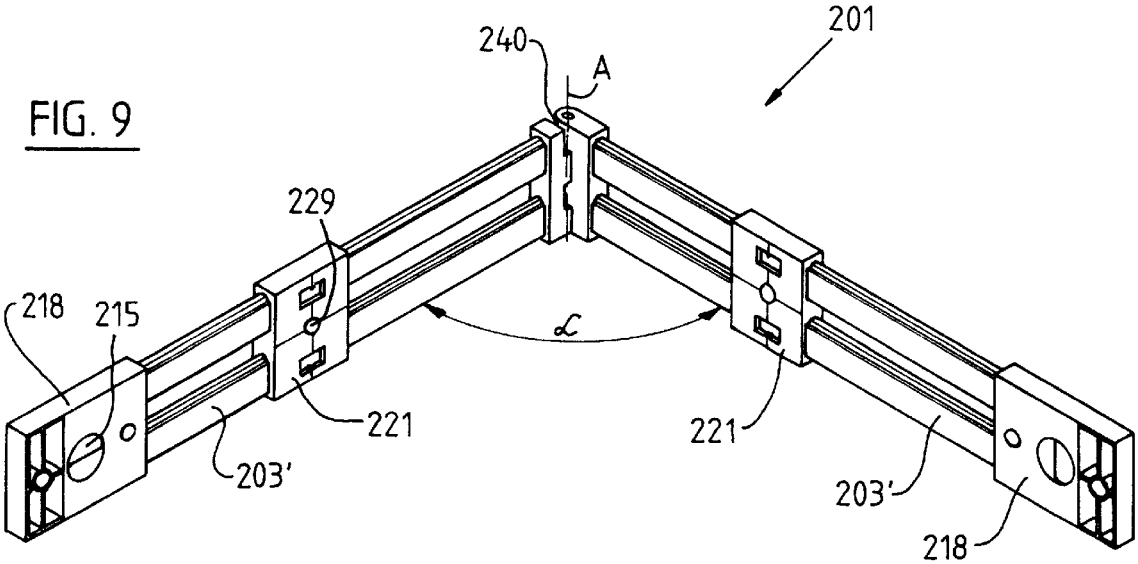

In yet a further, preferred embodiment of the present invention, as illustrated in FIG. 9, which is especially intended for the marking of tiles or furniture placed across a corner, the alignment device 201 contains a joint 240. The joint 240 connects the ends of the bar-shaped frames 203' and enables the device 201 to pivot around the axis A at any desired angle alpha. With the bubble level 215, they can aligned horizontally by the two angular sides comprising the bar-shaped frames 203'. Preferably, cursors 221, with boreholes 229, are attached to both sides of this embodiment. This arrangement makes it possible to set markings at fixed distances to the corner and/or to a different point at the two walls coming together where the alignment device 201 is applied.

While only several embodiments of the present invention have been shown and described, it will be obvious to those skilled in the art that many modifications may be made to the present invention without departing from the spirit and scope thereof.

What is claimed is:

1. An article for aligning attachment means for hanging pictures, and picture frames, and for marking fastening points on a wall, said article for aligning attachment means comprising:

a frame having at least one bubble level mounted therein, said frame including, at least, one first borehole at one end of said frame;

a cursor having a second borehole guided along said frame, the second borehole lying over a slit in said frame with the slit running parallel to at least one longitudinal edge of said frame and parallel to at least one of said first boreholes of said frame, said cursor having a C-shaped portion for grabbing said frame; said cursor having a marking means extending through said second borehole and said slit; and, a plurality of steps on said frame for a precise guiding of said cursor along at least one of the longitudinal edges of said frame, said plurality of steps cooperable with complementarily designed surfaces on an internal contour of said cursor.

2. The article for aligning attachment means according to claim 1, further comprising at least one elastic flap shaped to said cursor for engaging the slit of said frame and maintaining a tension for said cursor on said frame.

3. The article for aligning attachment means according to claim 1, further comprising an additional frame with said frame and said additional frame lying parallel to one another and held together via retaining elements at both ends of said frame and said additional frame.

4. The article for aligning attachment means according to claim 3, wherein said frame and said additional frame each include a hollow section on at least one longitudinal edge thereof, which includes a plurality of trapezoidal steps for engaging complementary surfaces of the inner contour of said cursor.

5. The article for aligning attachment means according to claim 3, further comprising a cover plate attached to each of said retaining elements, each of said cover plates including a bubble level.

6. The article for aligning attachment means according to claim 5, wherein said cover plates include detachment means for detaching each of said cover plates from said retaining elements.

7. The article for aligning attachment means according to claim 5, wherein each of said cover plates includes a borehole designed for the purpose of permitting a marking procedure.

8. The article for aligning attachment means according to claim 1, further comprising at least one centering arbor for insertion into one of said first borehole or said second borehole.

9. The article for aligning attachment means according to claim 1, wherein said frame comprises two component frame portions connected to one another via a joint.

10. The article for aligning attachment means according to claim 9, wherein one of said cursors is placed upon each of said two component frame portions.

* * * * *